US012318026B2

(12) United States Patent
Williams

(10) Patent No.: US 12,318,026 B2
(45) Date of Patent: Jun. 3, 2025

(54) MODULAR BED LINEN HANGER AND STORAGE SYSTEM

(71) Applicant: Jacqueline Williams, Crosby, TX (US)

(72) Inventor: Jacqueline Williams, Crosby, TX (US)

( * ) Notice: Subject to any disclaimer, the term of this patent is extended or adjusted under 35 U.S.C. 154(b) by 0 days.

(21) Appl. No.: 17/859,077

(22) Filed: Jul. 7, 2022

(65) Prior Publication Data

US 2024/0008668 A1 Jan. 11, 2024

(51) Int. Cl.
*A47G 25/18* (2006.01)
*A47G 25/28* (2006.01)
*A47G 25/40* (2006.01)

(52) U.S. Cl.
CPC ..... *A47G 25/183* (2013.01); *A47G 25/28* (2013.01); *A47G 25/40* (2013.01)

(58) Field of Classification Search
CPC ..... A47G 25/183; A47G 25/18; A47G 25/28; A47G 25/40
USPC ..... 211/85.3
See application file for complete search history.

(56) References Cited

U.S. PATENT DOCUMENTS 1,741,068 A * 12/1929 Newsom ..... A01M 29/12 223/86
2,492,226 A * 12/1949 Kohl ..... A47G 25/743 211/85.3
2,646,195 A * 7/1953 Kleist ..... A47G 25/26 211/85.3
2,672,989 A * 3/1954 Creveling ..... A47G 25/18 211/113
D191,647 S * 10/1961 Seeger ..... 211/85.3
3,081,881 A * 3/1963 Seeger ..... A47G 25/743 211/85.3
D205,257 S * 7/1966 Hellinger ..... D6/315
3,783,995 A * 1/1974 Tobin ..... B65D 85/18 211/89.01
2,401,835 A * 9/1974 McFall ..... A47G 25/743 211/85.3
3,837,476 A * 9/1974 Schwartz ..... B65D 85/18 206/45.24
4,651,873 A * 3/1987 Stolcenberg ..... B65D 71/50 206/427

(Continued)

FOREIGN PATENT DOCUMENTS

GB 2406267 A * 3/2005 ..... A47G 25/18
KR 101458842 B1 * 11/2014

*Primary Examiner* — Stanton L Krycinski

(57) ABSTRACT

The modular bed linen hanger and storage system enables one to store and easily transport multiple bed linen items. These items can include sheets, blanks, bedspreads, and pillow cases. This hanger and storage system has multiple panel sections having front and back surfaces. Openings through these panel surfaces allow for inserting items through these openings. After partial insertion of an item, the item can rest in that panel section until needed. Multiple openings in the multiple panel sections enable this hanger storage system to hold and store many bed linen items simultaneously. Rollers attached to the bottom of this hanger and storage system allow more accessible transport of the system when desired. Further, foldable and detachable panel sections enable one to vary the length of the hanger. The foldable panel sections also facilitate easier transport of the hanger and storage system when not in use.

9 Claims, 9 Drawing Sheets

(56) References Cited

U.S. PATENT DOCUMENTS 4,944,417 A * 7/1990 Datlow ..... A47G 25/1471 211/184
4,966,287 A * 10/1990 Snyder ..... A45C 11/16 211/85.2
D321,795 S * 11/1991 Winston ..... D6/513
D323,748 S * 2/1992 LaCroix ..... D6/318
D323,755 S * 2/1992 Harney ..... D6/571
D341,946 S * 12/1993 Graffigna ..... D6/513
5,385,245 A * 1/1995 Waters ..... A47G 25/18 211/85.3
5,667,081 A * 9/1997 Pund-Hogan ..... B07C 7/02 211/10
5,779,033 A * 7/1998 Roegner ..... A45C 7/0095 206/6.1
D401,705 S * 11/1998 Jones ..... D32/58
6,196,396 B1 * 3/2001 Bennett ..... A47F 7/12 211/85.2
6,296,128 B1 * 10/2001 Isserstedt ..... B42F 17/18 211/113
6,769,555 B2 * 8/2004 Brady ..... A47G 25/743 211/89.01
D534,361 S * 1/2007 Wolf ..... D23/366
7,389,868 B2 * 6/2008 Lewand ..... A47G 1/12 211/85.2
7,481,340 B2 * 1/2009 Murphy ..... A47G 25/743 211/85.3
D601,798 S * 10/2009 Hsu ..... D3/903
7,712,641 B2 * 5/2010 Snyder ..... A47G 25/14 211/85.3
8,657,124 B2 * 2/2014 Brown ..... A47G 25/005 211/85.3
8,851,089 B1 * 10/2014 Rogers ..... A45C 11/26 132/312
8,944,298 B2 * 2/2015 Hickey ..... A47G 25/18 211/85.3
8,985,348 B2 * 3/2015 Prado ..... A47G 25/18 211/85.3
D737,583 S * 9/2015 Li ..... D6/319
9,271,585 B1 * 3/2016 Chung ..... A47F 7/021
D765,433 S * 9/2016 Berger ..... D6/319
D766,600 S * 9/2016 Barre ..... D6/319
11,045,030 B2 * 6/2021 Hong ..... A47G 25/20
11,085,145 B2 * 8/2021 Halawani ..... A47G 25/40
11,124,341 B2 * 9/2021 Patton ..... B65D 71/504
11,147,404 B1 * 10/2021 Duffy ..... A47B 43/003
2004/0222125 A1 * 11/2004 Meing ..... A45C 11/26 206/581
2007/0289929 A1 * 12/2007 Rogers ..... A47G 25/74 211/85.3
2010/0193383 A1 * 8/2010 Parness ..... A45C 3/004 206/288
2012/0138643 A1 * 6/2012 Fandi ..... A47G 25/28 53/429
2014/0111073 A1 * 4/2014 Kunis ..... A47B 87/00 211/85.3

* cited by examiner

MODULAR BED LINEN HANGER AND STORAGE SYSTEM

FIELD

This invention relates to a device for hanging, storing and transporting linen and bedding items. More particularly, this invention relates to a modular, convertible and changeable linen hanger system capable of storing and transporting various types of types of bedding and bathroom products.

BACKGROUND

Bed linens comprise numerous items, including sheets, pillowcases, bedspreads, blankets, and comforters. A general practice is storing these things in closets or pantry areas. In a home or residential setting, there is little need to transport these items more than a short distance to a bedroom, laundry room, or cupboard.

Hotels and motels also use a substantial number of sheets, pillow cases, and bedspreads in the numerous facility rooms. During cleaning these rooms, workers usually store and transport these bedding items in mobile carts. Storage of these items can be on multiple shelves or in closet areas. However, in some circumstances, closets may not have sufficient storage capacity. In other cases, closet and cabinet space may not be available.

When it comes to storing clothing items, the conventional approach is to place the clothing item on a hanger. This form of storage can have several benefits, including saving space and reducing the wrinkles in the clothing item. It is also a common practice to store clothing items in drawer or cabinet spaces. However, placing these items on a hanger device is standard for shirt and pants items (items somewhat similar to bedding).

The clothing hanger allows people to access their items quickly and provides a permanent space and location in their homes to store and keep their things. In addition, as mentioned, hanging clothing items serves to reduce or prevent wrinkling of some clothing items. Three basic designs cover all clothing hangers substantially. Regarding materials and construction, there are three basic clothes hangers: wire hangers, wooden hangers, and plastic hangers. These hangers all have the same basic shape. The top of the hanger is a hook element. Two rod-type members are connected to and extend downward at an angle from the hook element. These rod-type members are intended to resemble a person's shoulder angles.

Hanger designs have evolved over time. As a result, different designs constantly provide innovation to the clothes hanger product. For example, U.S. Pat. No. 8,028,869 describes an adjustable clothes hanger with an adjustable sleeve upper stays, sleeve lower stays, and torso side stays. These components adjust to spread the sleeves and torso of a shirt on the hanger to hold the fabric in a smooth, lightly stretched condition to optimize drying and preclude wrinkling. The hanger has opposed sleeve upper stays, which adjust along with the underlying frame of the hanger. The outer portions of the sleeve upper stays extend to support the shirtsleeve upper edges. The Torso side stays extended downwardly from the horizontal cross member of the hanger. It adjusts to hold the shirt's sides apart and hold the torso fabric in a smooth and unwrinkled condition during drying. Pivotal or fixed sleeve lower stays may extend from the upper portions of the torso side stays or may extend adjustably from the outer ends of the adjustable sleeve upper stays.

U.S. Pat. No. 7,086,635 describes an improved hanger for storing and displaying materials such as fabric and the like. The hanger includes opposed panel sides interconnected at an upper spine portion. Fabric or other material is placed between the panels. It is retained by a unique set of clips applied externally on the panel sides combined with high-friction components, including friction plates or clips with friction nibs positioned within the panels. A resilient spring clip is moved into a gripping position to impart pressure to the assemblage. Embodiments of the friction plates include a first U-shaped bracket element designed to be friction fitted along a side of one of the panels. In contrast, a second U-shaped bracket element is configured to be friction fitted along with an opposing panel. The first bracket includes a detent arrangement for retaining the spring clip in a gripping position. The second bracket consists of a spring clip retaining arrangement to prevent detachment of the spring clip when it is moved to its release position.

U.S. Pat. No. 4,234,088 describes a hanger for carrying piece length fabric in a pendant, the vertical roll includes a support assembly, and a hanger assembly removably supported thereon. The support assembly includes a base portion and a substantially flat central body portion connected at one end thereof to the base portion to be supported in an upstanding position. The main body has longitudinally extending edges, forming a core for supporting the roll of fabric. The hanger assembly is carried at the end of the main body portion opposite the base portion. The hanger assembly includes a longitudinally extending main support member with securing units carried at opposite longitudinal ends of the support member. The securing units may be of a variety of types with either single or double-pointed members and may include a stationary safety bar spaced from the pointed members. The hanger assembly carries an attachment hook for supporting the main support member in a generally horizontal position. Ties that extend through the fabric and a portion of the support assembly may also be used to securely hold the fabric on the support assembly during transport.

Other patents, such as U.S. Pat. D946,288, describe a sectioned clothes hanger, and U.S. Pat. D651,813 show a Fabric Hanger device. Also, there are garment devices used to store fabric comprising center support and rails extending horizontally outward from the center support.

These rails hold different fabrics. One can retrieve the type of fabric as needed. However, with all the various hanger devices for storing clothing and other fabric materials, none of these existing devices or systems are designed to accommodate storing bed linens such as sheets, bedspreads, and pillow cases. There remains a need for an apparatus and method capable of storing and transporting bed linens.

SUMMARY

A modular hanger system enables one to store and transports various linen products used on bedding. This hanger system can be a solid rectangular piece with a series of openings for storing different linens. This hanger system can also be multiple solid rectangular panels connected together to form the hanger system. Each panel can have one or more openings through which linen materials are secured and stored. These panels can fold together to facilitate portability. A hook-type element attaches to the top of the rectangular piece or series of panels. The hook element promotes the hanging function similar to conventional hangers. In addition, during storage and transport of this modular linen hanger system, the hook element can fold down.

The modularity capabilities of the system provide the flexibility to vary the length of the system when desired. For example, the number of connected panels can be added to or removed from the system to change the system length as desired. Other embodiments can have rods attached to and angled downward from the hook element and attached to the top panel to form a top section of the system. This top section has a form and shape similar to some conventional hangers. The ends of this top section are foldable to reduce the size of the width of the horizontal length of the system to facilitate more accessible transport of the system

DETAILED DESCRIPTION OF THE INVENTION

The present invention provides a modular hanger device to store and transport linen bedding items such as sheets, pillowcases, bedspreads, and comforters. With this device and system, the user can easily store these bedding items to save storage space and transport them when desired. In addition, this system's modularity provides easy storage of the device to save space when not in use.

Figure 1:
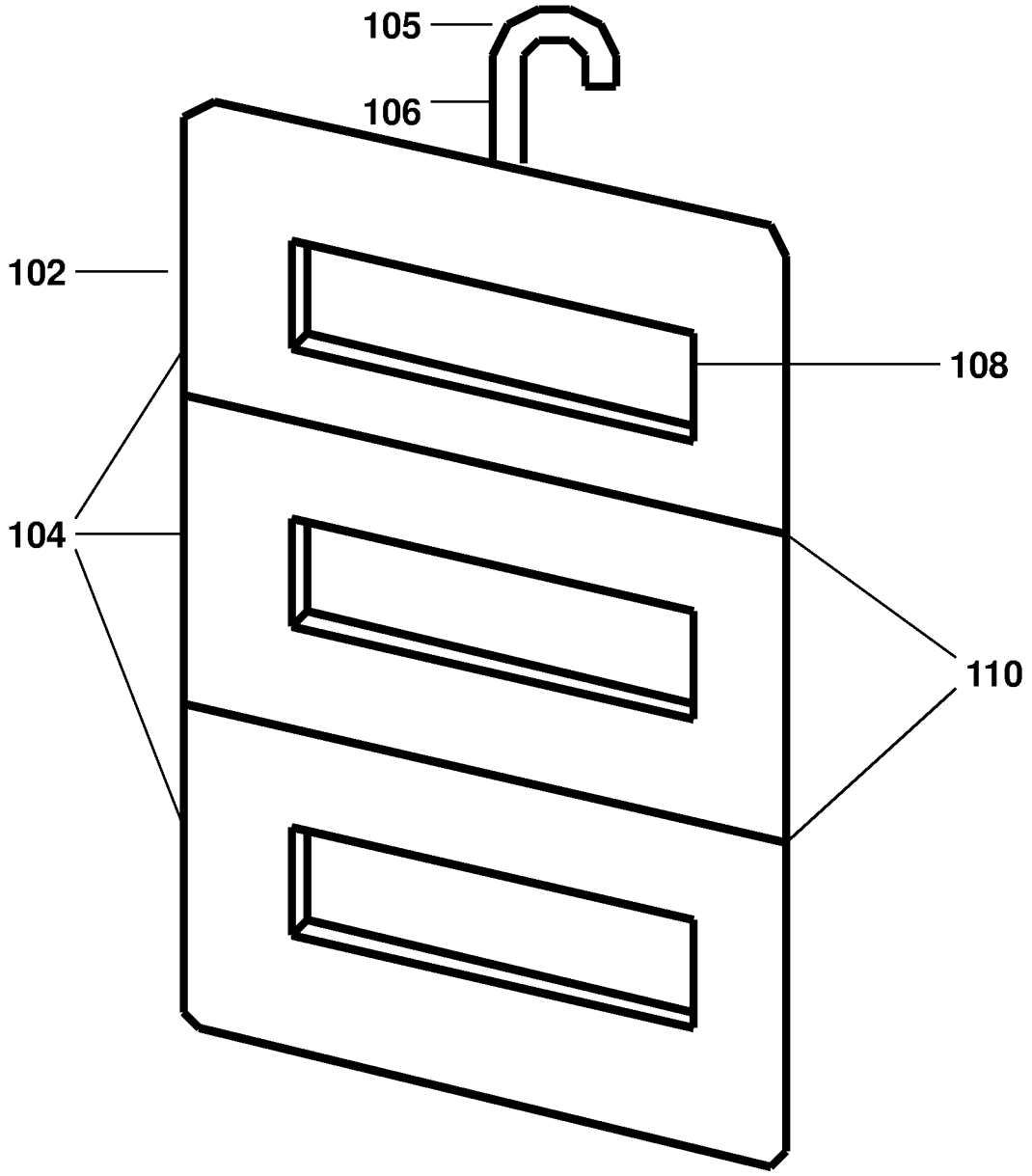
FIG. 1 is an illustration of an embodiment of the modular linen hanger system of the present invention.

FIG. 1 illustrates the basic design and embodiment of the hanger device of the present invention. This device 102 comprises one or more panel elements 104 connected together at one end 110. These panels can have a rectangular shape with a top edge and a bottom edge. These panels also comprise a flat surface 107 with a center opening 108. This opening is critical as it provides the space for storing the linen item. When the device only comprises one panel 104, as shown, the shape of that single panel can still have a rectangular shape. In this single panel embodiment, the panel can have multiple center openings. These center openings 108 should be sufficient to readily accommodate the various bed linen items. Connected to the top edge of panel 104 is a hook element to engage and store the hanger device. This hook element has a neck portion that can be a linear rod-like element 105 and a curve element 106 that serves as a hook that will support the hanger device when positioned on a door, wall, or other location.

Figure 2:
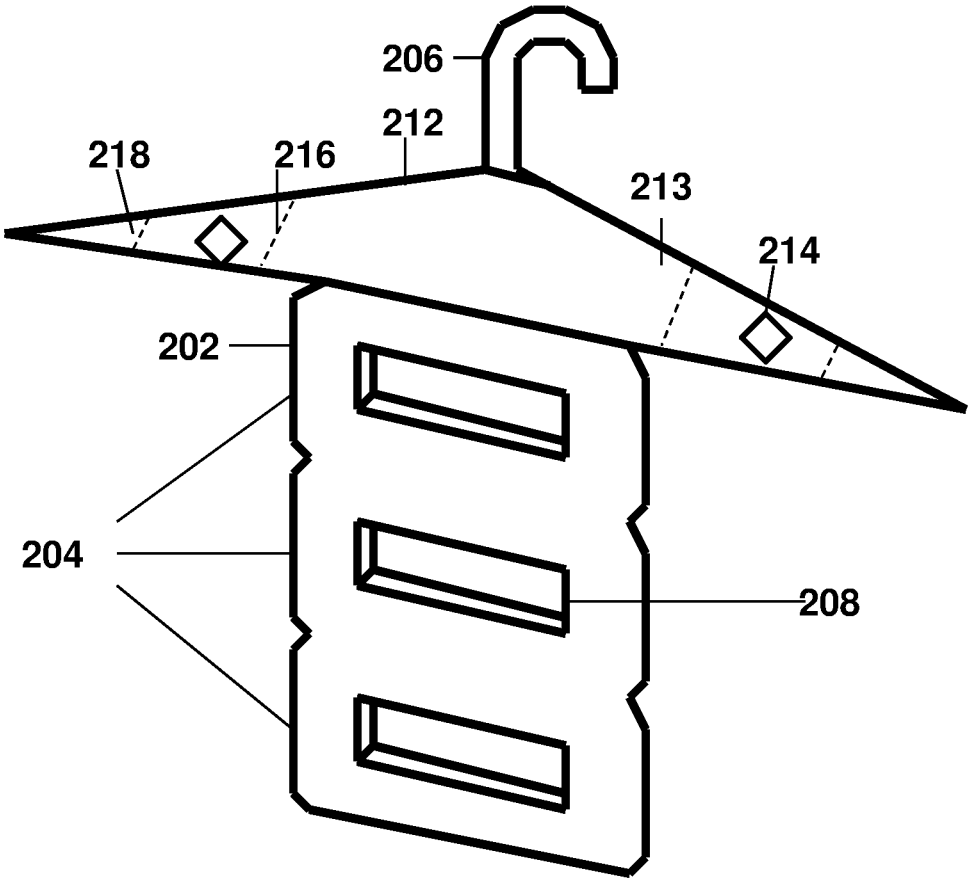
FIG. 2 is an illustration of an alternate embodiment of the modular linen hanger system as one solid piece.

FIG. 2 shows an alternate embodiment of the modular linen hanger system as one solid piece. The hanger system 202 contains the one-piece 204 with multiple sections and multiple center openings 208. However, the top portion of this hanger system resembles a triangular shape 212 with edges that flare and extend outward from a hook element 206 at its top. Similar to the one-piece section 204, this triangular top section can have a flat smooth surface 213. Within this top section, 212 are openings 214. These openings provide spaces for storing smaller linen items such as pillow cases. Folding creases 216 and 218 provide the means to fold the side edges of this top section when the hanger is not in use to save space and optimize storage.

Figure 3:
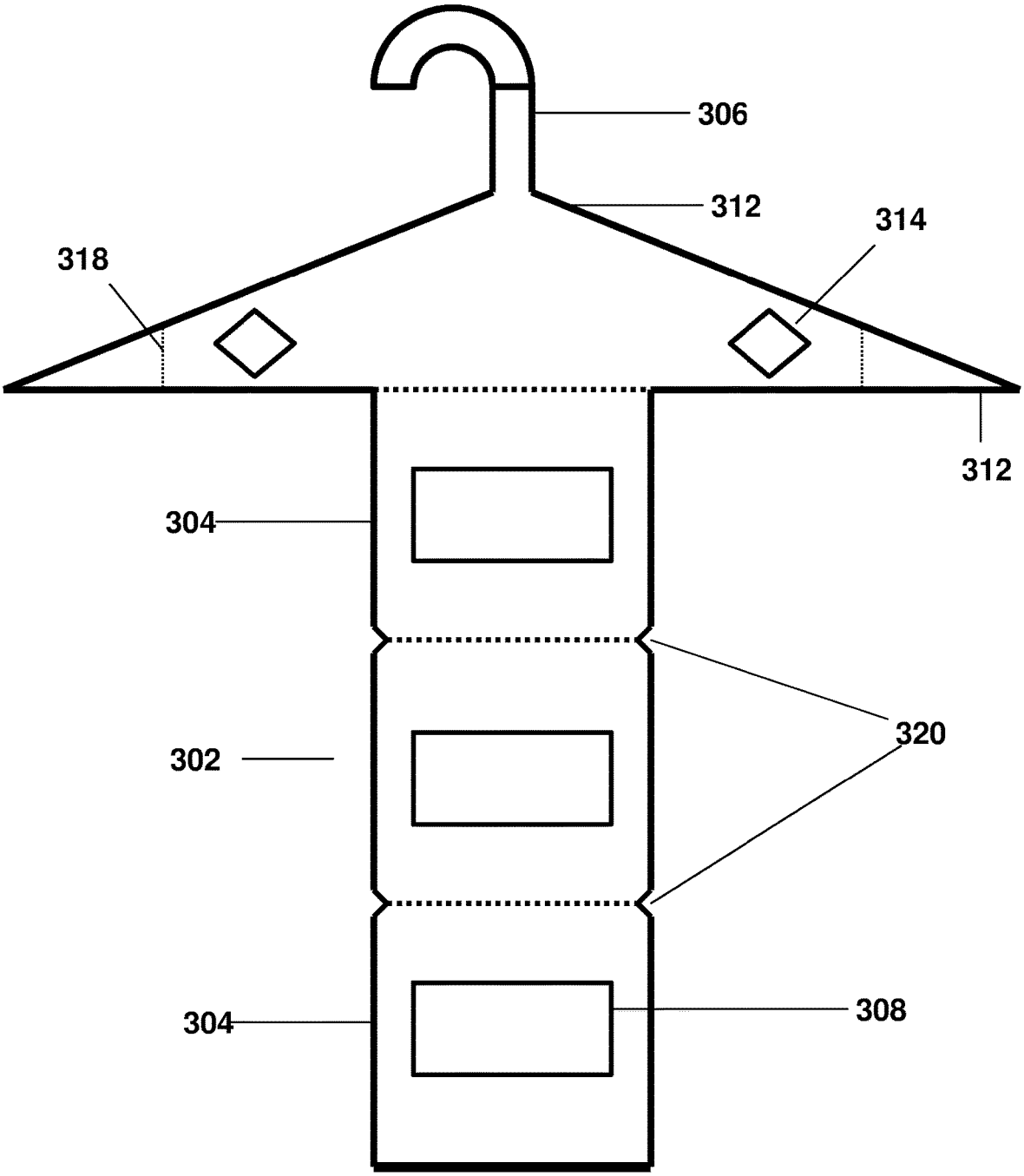
FIG. 3 is an illustration of an alternate embodiment of the modular linen hanger system with multiple detachable sections connected together.

FIG. 3 illustrates an alternate embodiment of the modular linen hanger system of FIG. 2, with multiple sections connected. Unlike the previously described one-piece embodiments, this embodiment 302 enables the user to alter the length of the hanger system by removing one or more of the lower connected panel elements 304. Again, each panel section contains a center opening 308. The panel elements connect to each other by connecting the bottom edge of the upper panel with the top edge of the lower panel 320. In this embodiment, various means can be employed to join the panel elements and secure them when the hanger system is in use. Some connectors can be hinges, rods, or latches to secure these panels in place. When the design contains detachable panels, means such as rods or hooks can perform the attaching function with locks or latches securing the panels in place. The top portion of the hanger system can have a design consistent with FIG. 2. The top triangular section 312 has openings 314 for storing items and creases 318 for folding the edges of the top section. The hook element 306 attaches to the top area, as previously explained.

Figure 4:
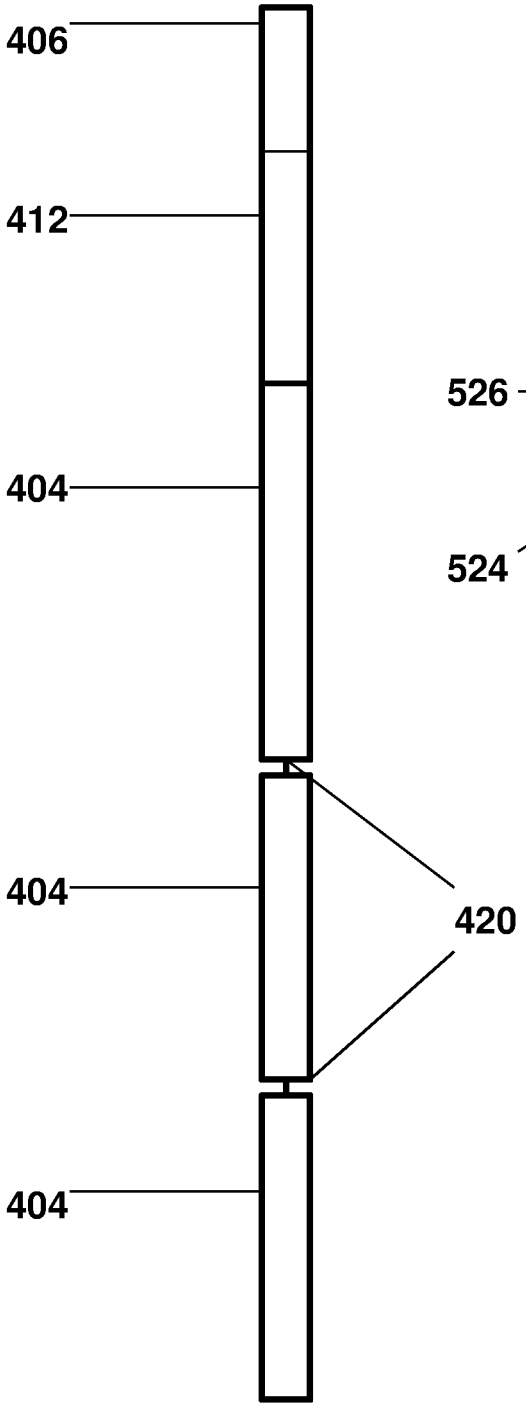
FIG. 4 is a side view of the modular linen hanger system showing the modular sections connected together.

FIG. 4 is a side view of the modular linen hanger system showing the modular sections connected together. This view illustrates how the various components of the hanger system of the present invention connect. The hook element 406 connects to the top section 412. This connection can facilitate the folding down of the hook element when the hanger system is not in use. The top section connects to the first or top panel section 404. The bottom edge of the top panel section connects to the top edge of the second-panel section 404. This same configuration exists for connecting second and third-panel sections and for as many additional as may be desired or feasible. The connection means 420 provides the flexibility to fold these sections or detach and reattach these sections as desired. A connection means can also be present between the top section and the first panel.

Figure 5:
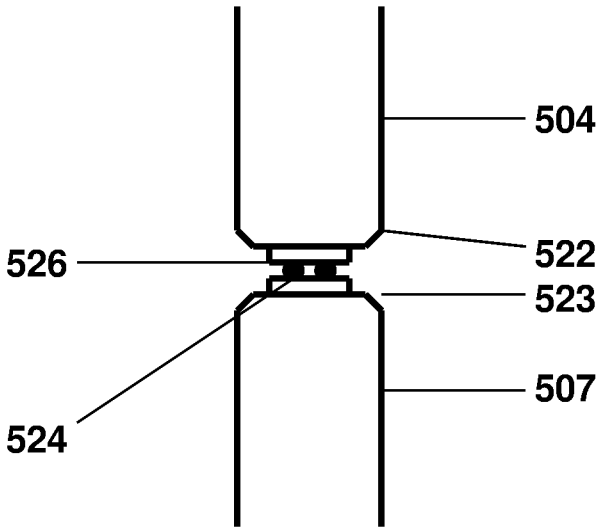
FIG. 5 is a close up view of a connector design joining two modular sections of the invention.

FIG. 5 is a close-up view of a connector design joining two modular sections of the invention. In this illustration, the connection means is a hinge system. This hinge system connects the lower edge 522 of the upper panel 504 with the upper edge 523 of, the lower panel 507. The hinge system can comprise metal plates 527 attached to the lower edge of panel 504 and the upper edge of panel 507. In addition, one or more metal rods 524 can connect these plates, thereby securing the upper and lower panels. These rods also facilitate the pivoting or rotating function of the hinge system to enable the user the fold the panels as desired or when necessary.

Figure 6:
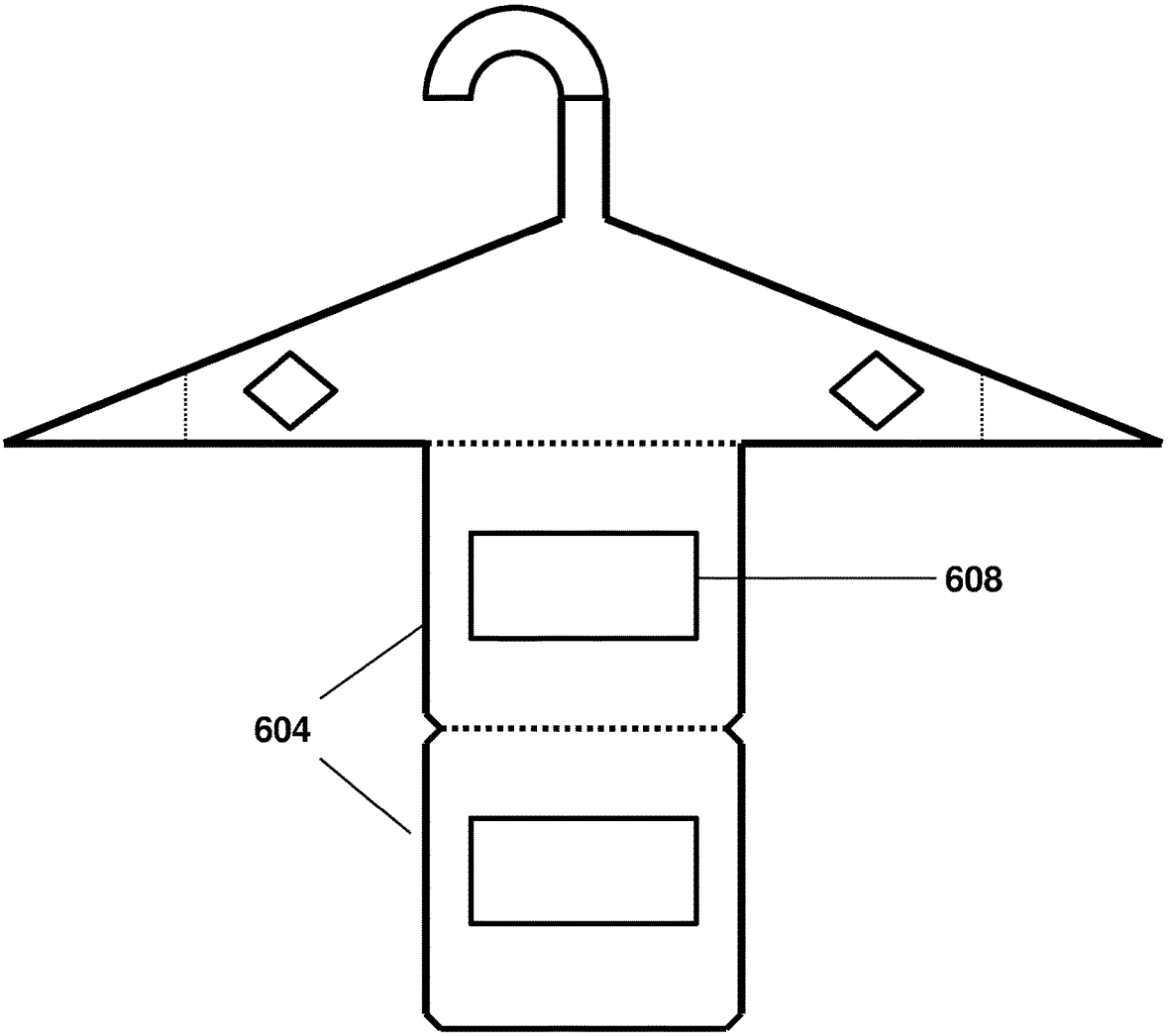
FIG. 6 is a view of a varied length embodiment of the modular linen hanger system of the present invention.

The modularity of this invention gives the user the flexibility to change the configuration of the hanger system. FIG. 6 is a view of a varied length embodiment of the modular linen hanger system of the present invention. As mentioned, an embodiment of this hanger can comprise multiple panels 604 and 608.

Figure 7:
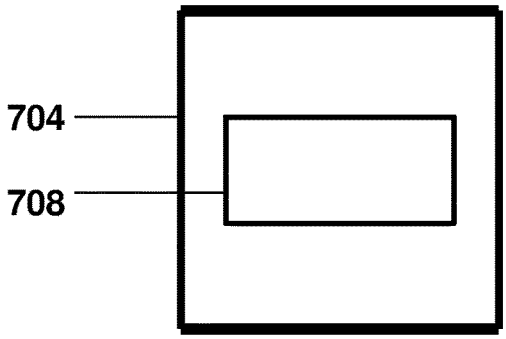
FIG. 7 is a close up view of the section panel of the modular linen hanger system.

In this illustration, the hanger comprises only two panels. In other embodiments, the user can add one or more panels or reduce the number of panels to one. For example, FIG. 7 shows an individual panel 704 containing a center opening 708. As previously stated, the user can detach the panel from the hanger to reduce the hanger length. Likewise, the user may fold up the bottom panel in another embodiment to minimize the hanger length.

Still, another approach is to attach the panels slidably. In the embodiment, one can slide a lower panel upward to the same length location as the adjacent upper panel. The lower panel would slide up and cover the upper panel in the same manner as folding the lower panel upward.

Figure 8:
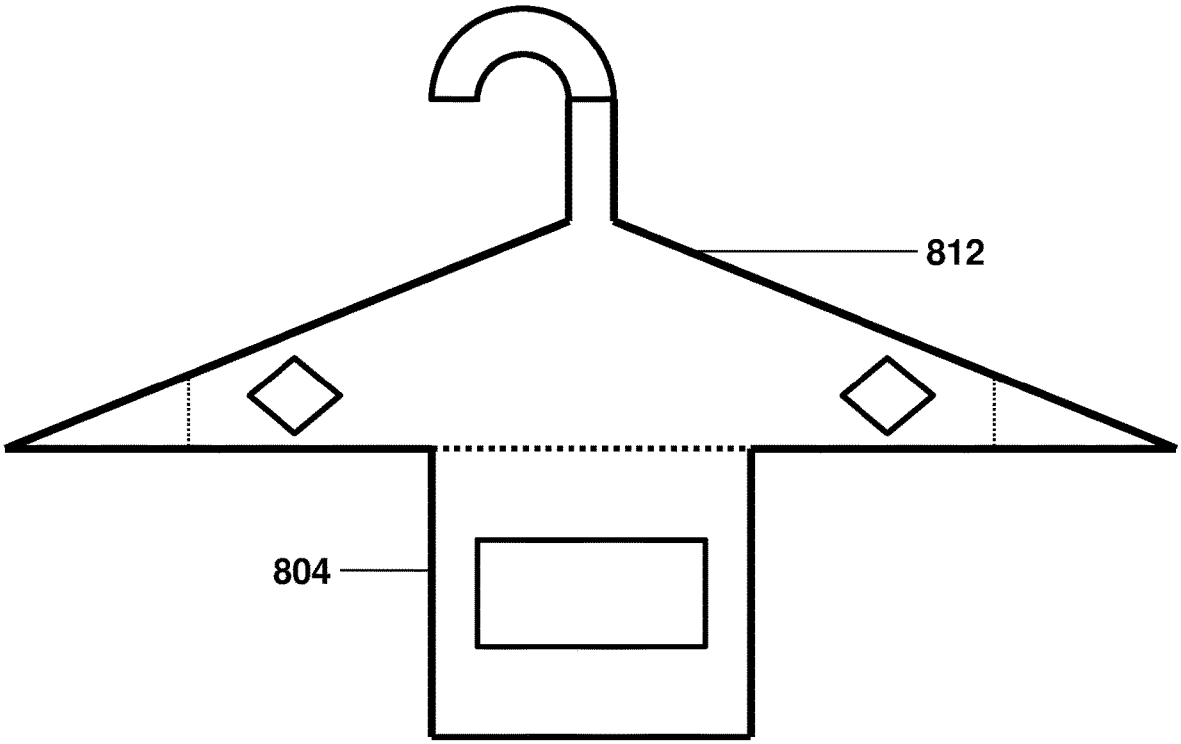
FIG. 8 is a view of the modular linen hanger system with one modular panel section.
Figure 9:
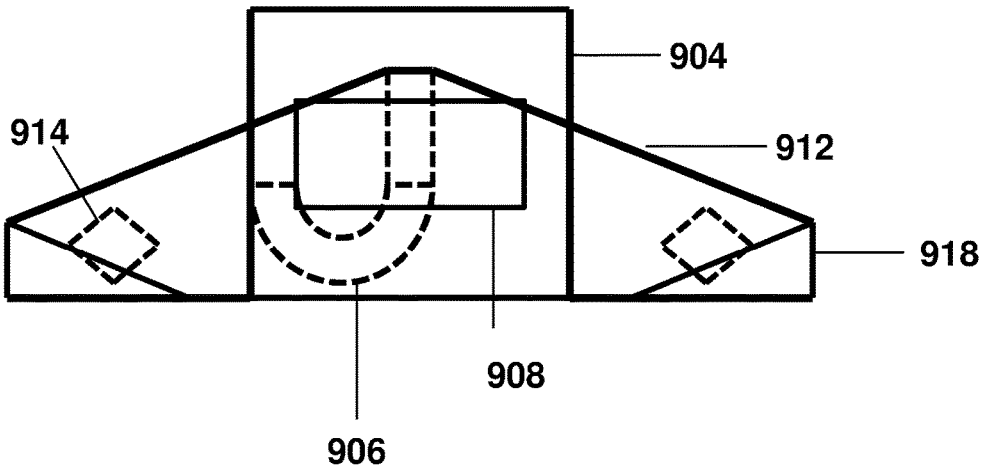
FIG. 9 is a view of the modular linen hanger system of the present invention folded for transport.

FIG. 8 shows a view of the modular linen hanger system with one modular panel, section 804. This one panel can be detachable from the upper section 812. In another embodiment, this panel can be affixed to the upper with the capability to fold if desired. FIG. 9 shows a folded modular hanger system of the present invention. The panel 904 with opening 908 can fold up over the upper section 912. The edges of the upper section 918 fold in front of the opening 914. The hook element 906 folds down over the upper section 912 and panel 904. The capability to fold the components of this modular hanger system provides conveniences for transporting the system when desired.

Figure 10:
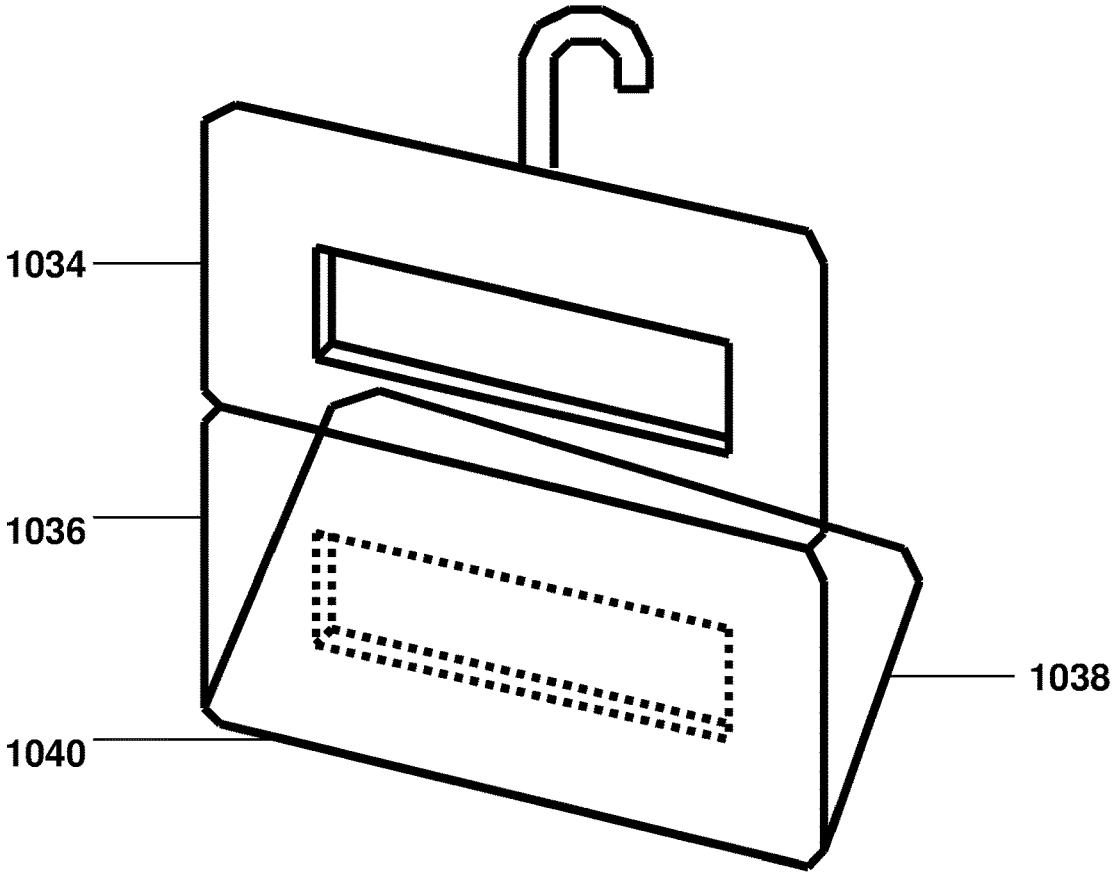
FIG. 10 is a view of the modular liner hanger showing a section being folded up.
Figure 11:
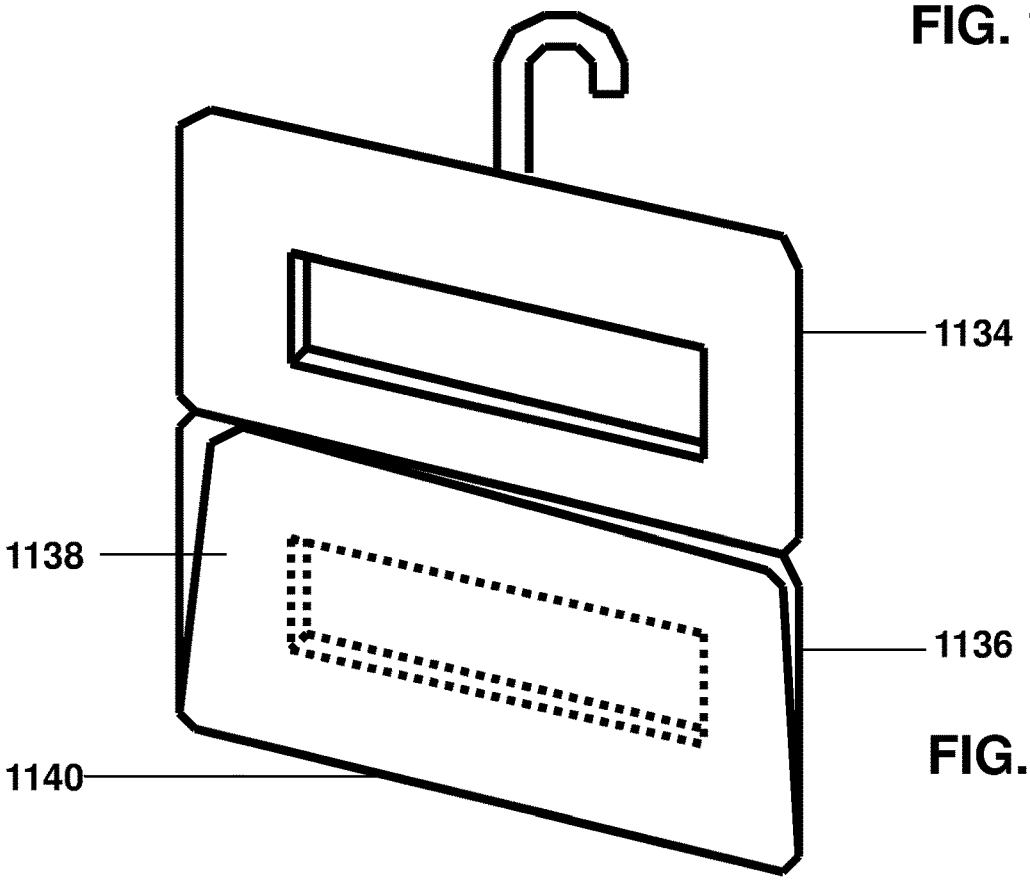
FIG. 11 is a view of the modular liner hanger showing the section folded up to shorten the length of the hanger system.

FIG. 10 shows the ability to shorten the length of the hanger system by folding the sections. Shown are sections 1034, 1036, and 1038. A connector device such as the previously mentioned hinge 1040 can attach the sections together. The hinge connector gives this system the capability for the sections to fold together. As shown in FIG. 11, the modular sections 1136 and 1138 fold up to shorten the length of the system. The hinge 1140 facilitates the folding process. These two folded sections 1136 and 1138 can also fold up to section 1134. When the sections are folded, a fastener can secure the sections in place.

Figure 12:
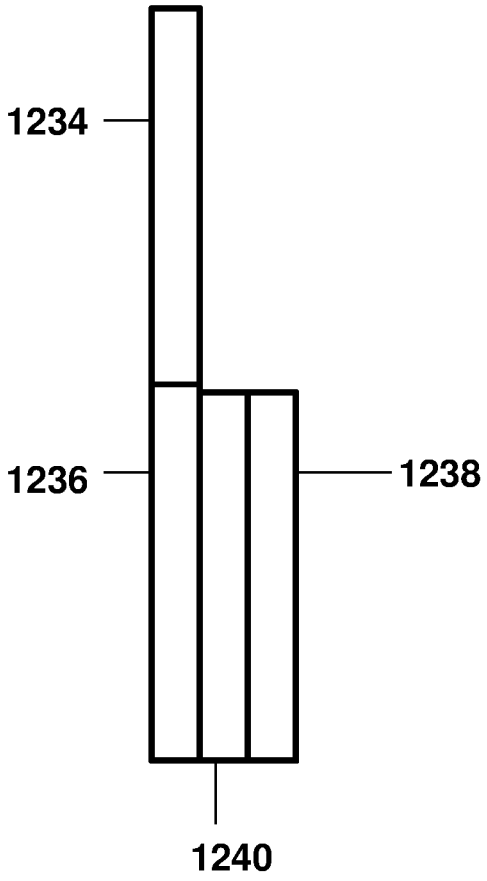
FIG. 12 is a side view of the modular liner hanger system showing folded sections.

FIG. 12 shows a side view of the liner hanger system of the present invention with the lower sections in a folded position. Sections 1236, 1238, and 1242 fold and lock together. Section 1234 can remain as it is, or the other sections can fold onto it. The folding of these sections primarily enables more straightforward transporting of this hanger system when it is not in use.

Figure 13:
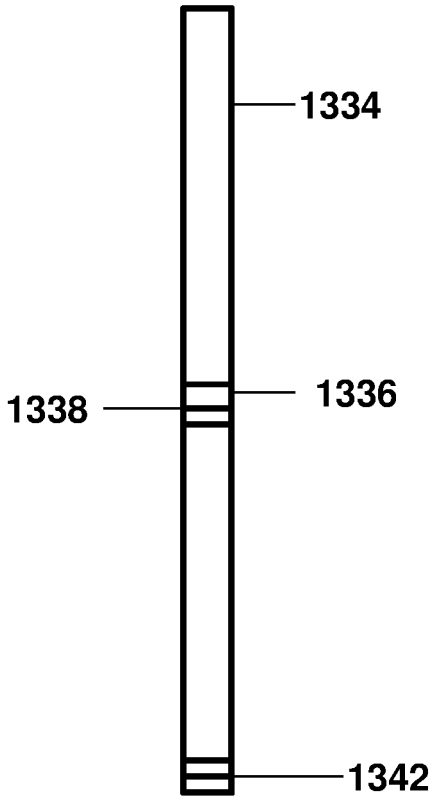
FIG. 13 is a side view of the modular liner hanger system of the present invention showing sections that slide up to shorten the length of the hanger system.

FIG. 13 shows a side view of sections that are slidably attached. In this embodiment, the sections are attached at the edges. Each section can slide upward or downward as desired. As shown, sections 1336, 1338, and 1342 slide to the same level as section 1334. In one embodiment, an engaging mechanism can enable the user to extend the lower section outward and then slide that section upward. Once at the desired position, the user can lock the moved-up section in place. This process can continue for each they desire to move.

Figure 14:
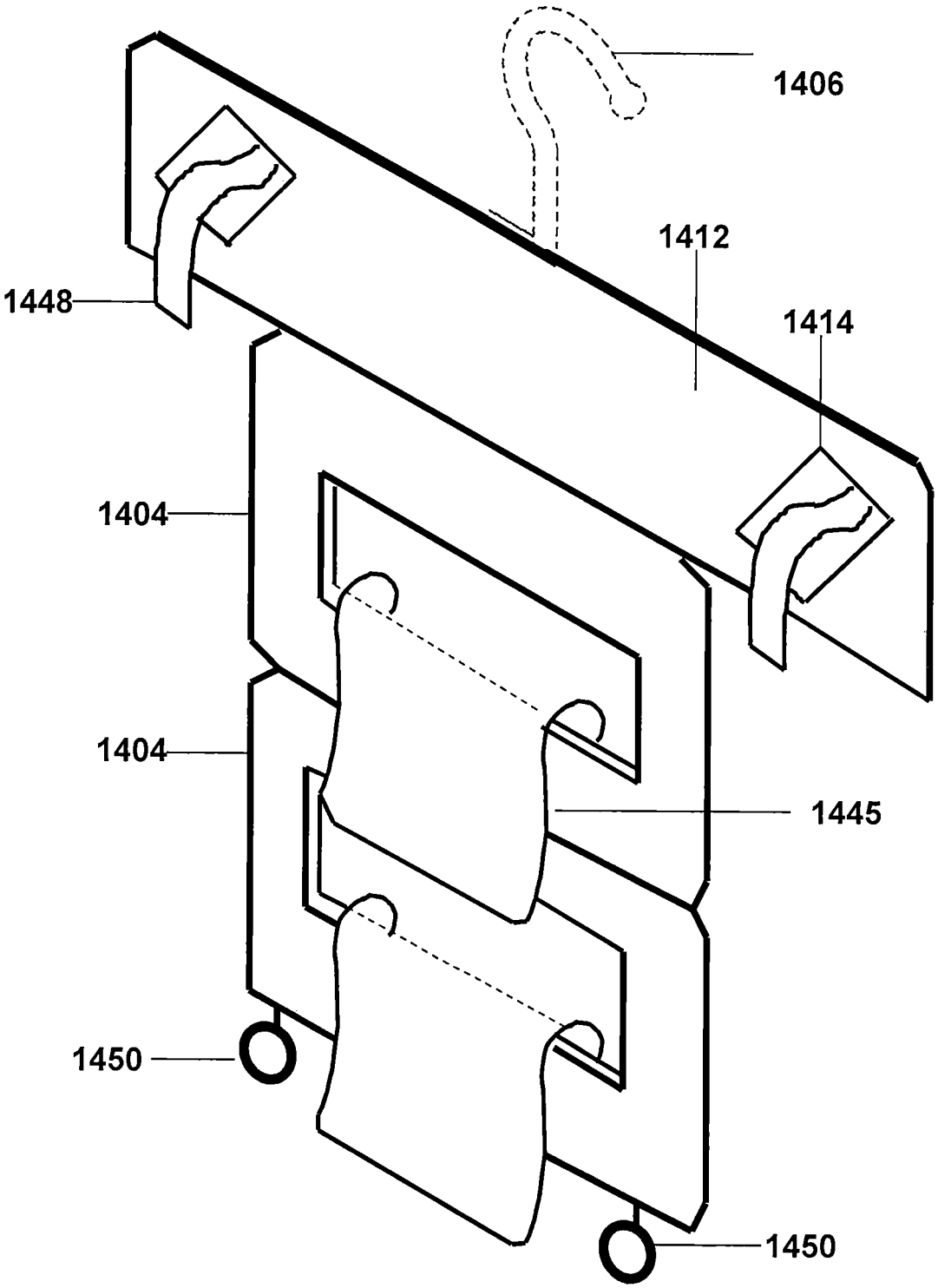
FIG. 14 is a front and top view of linen pieces being stored in the modular linen hanger system of the present invention.

FIG. 14 is a front and top view of linen pieces stored in the present invention's modular linen hanger system. Shown is the modular linen hanger system of the present invention holding and keeping various linen pieces. The system has the hook 1406 at the top of the hanger. The top section 1412 has openings 1414 that can hold smaller items 1448, such as pillow cases. The modular sections 1404 have openings that can store and hold more oversized linen items 1445, such as sheets. This modular hanger system can be equipped with attachable rollers 1450 to the bottom section to enable one to move this system conveniently and to make the system portable. The rollers can be fixed or removable as desired. These features make this system a helpful tool for those using, transporting, and storing linen materials.

While the description of embodiments thereof has illustrated the present invention, and while the embodiments have been described in some detail, it is not the intention of the applicant to restrict or in any way limit the scope of the invention to such information. Additional advantages and modifications will readily appear to those skilled in the art. In its broader aspects, the invention is not limited to the specific details, representative apparatus and methods, and illustrative examples shown and described. Accordingly, departures may be made from such details without departing from the spirit or scope of the applicant's general inventive concept.

What is claimed is:

1. A modular hanger and storage device for bed linen comprising:

a hook section for supporting the hanger when the hanger is stored;

a top section in the form of a plane having a flat front and back surfaces, and extending downward with a top edge, and a bottom edge and extending outward where said top and bottom edges meet a left side edge and a right side edge, and forming a top section with four connected edges, and said top edge of said top section being connected to said hook section and having openings through said front and back surfaces to facilitate storing of linen items; and a body section connected to said bottom edge of said top section and extending downward from said bottom edge of said top section, said body section comprising panel sections and each panel section being in the form of a plane having smooth front and back surfaces, a top edge and a bottom edge and extending in a downward direction from said top section, said body section having left and right side edges and two or more openings through said front and back surfaces and extending in a downward direction from said top edge of said body section to facilitate storing of linen items, said panel sections being connected to each other such that the bottom edge of one panel section connects to the top edge of another panel section such that these connected panel sections form said body section said panel sections of said body section are connected to facilitate varying body section length as desired, said panel sections being slidably attached at said left and right sides edges such that a lower panel section has the capability to slide up and lock to an upper panel section such that the body has a length that is varied as desired.

2. The modular hanger and storage device for bed linen as described in claim 1 wherein said slidably attached panel sections are detachable from and reattachable to each other to further vary body section length as desired.

3. The modular hanger and storage device for bed linen as described in claim 1 further comprising two or more rollers attached to said bottom edge of said body section, said rollers facilitate easier movement of said modular hanger and storage device.

4. The modular hanger and storage device for bed linen as described in claim 1 wherein said top section has right and left sides having vertical creases that enable said right and left sides of said top section to fold inward to decrease said top section width.

5. The modular hanger and storage device for bed linen as described in claim 1 wherein said hook section connects to said top section such that said hook section can fold down along side front or back surface of said top section.

6. A modular hanger and storage device for bed linen comprising:

a hook section for supporting the hanger when the hanger is stored;

a top section in the form of a plane having flat front and back surfaces and extending downward with a top edge top that comprises a center point, and top edges that slope downward in opposite directions from said center point to where said top edge meets a bottom edge of the top section, and said top edge of said top section being connected to said hook section at said center point of said top section and having openings through said front and back surfaces to facilitate storing of linen items; and a body section connected to said bottom edge of said top section and extending downward from said bottom edge of said top section, said body section comprising panel sections with each panel section being in the form of a plane with a top edge and a bottom edge and having smooth front and back surfaces and extending in a downward direction from said top edge of each panel and having two or more openings through said front and back surfaces to facilitate storing of linen items, said panel sections being connected to each other such that the bottom edge of one panel section connects to the top edge of another panel section such that these connected panel sections form said body section, said panel sections also being slidably attached at left and right sides edges such that a lower panel section has the capability to slide up and lock to an upper panel section such that the body has a length that is varied as desired.

7. The modular hanger and storage device for bed linen as described in claim 6 wherein said slidably attached panel sections are detachable from and reattachable to each other to further vary body section length as desired.

8. The modular hanger and storage device for bed linen as described in claim 6 further comprising two or more rollers attached to said bottom edge of said body section, said rollers facilitate easier movement of said modular hanger and storage device.

9. The modular hanger and storage device for bed linen as described in claim 6 wherein said top section has right side and left sides having vertical creases that enable said right and left sides of said top section to fold inward to decrease top section width.

* * * * *